US012402697B2

(12) United States Patent
Wu

(10) Patent No.: US 12,402,697 B2
(45) Date of Patent: Sep. 2, 2025

(54) MULTI-POINT BUCKLE

(71) Applicant: TAIWAN RACING PRODUCTS CO., LTD., Dacun Township, Changhua County (TW)

(72) Inventor: Wen-Yuan Wu, Dacun Township, Changhua County (TW)

(73) Assignee: Taiwan Racing Products Co., Ltd., Dacun Township (TW)

( * ) Notice: Subject to any disclaimer, the term of this patent is extended or adjusted under 35 U.S.C. 154(b) by 0 days.

(21) Appl. No.: 18/421,979

(22) Filed: Jan. 24, 2024

(65) Prior Publication Data

US 2025/0234965 A1 Jul. 24, 2025

(51) Int. Cl.
*A44B 11/25* (2006.01)

(52) U.S. Cl.
CPC ..... *A44B 11/2569* (2013.01); *A44B 11/2542* (2013.01); *A44B 11/2561* (2013.01); *A44B 11/2549* (2013.01)

(58) Field of Classification Search
CPC ..... A62B 35/0018; A62B 35/0025; A62B 35/0031; A62B 35/0006; A62B 35/0012; A44B 11/2561; A44B 11/2546; A44B 11/2542; A44B 11/253; A44B 11/2526; A44B 11/25; A44B 11/2549; A44B 11/2576; A44B 11/20; B60R 22/00; B60R 22/001; Y10T 24/45613; Y10T 24/45607; Y10T 24/45618; Y10T 24/45084
See application file for complete search history.

(56) References Cited

U.S. PATENT DOCUMENTS

| | | | | |
|---|---|---|---|---|
| 6,769,157 | B1 * | 8/2004 | Meal | A44B 11/2576 24/579.11 |
| 11,825,917 | B1 * | 11/2023 | Wu | A44B 11/20 |
| 2012/0036687 | A1 * | 2/2012 | McGlynn | A44B 11/2576 24/633 |

* cited by examiner

*Primary Examiner* — Jason W San
*Assistant Examiner* — Michael S Lee

(57) ABSTRACT

A multi-point buckle has a buckle, at least two latches and a plurality of dust jackets. The dust jacket is employed between the latch and the tongue slot of the buckle to achieve a close fit and seal effects, which not only increases the structural engagement stability between the tongue slot and the tongue but also prevent sand, dust and dirt from falling into the tongue slot not causing the latch from shaking loose and the friction and interference of foreign objects in the buckle.

5 Claims, 8 Drawing Sheets

A-A

MULTI-POINT BUCKLE

BACKGROUND OF INVENTION

Field of Invention

The present invention relates to a multi-point buckle, and more particularly to a multi-point buckle capable of preventing from dust.

Description of the Related Art

In order to ensure the safety of the drivers and the passengers in the vehicle, among the standard equipment of the vehicle, the safety belt is a necessary basic equipment in the car. However, the applications of the vehicle are quite extensive now, such as off-road vehicles or all-terrain vehicles . . . etc. which frequently driving in sandy or muddy environment even wading streams and other unfavorable environments, so that sand or dust can easily invade the car. Seat belts used to fix the driver and passengers in the car attached to the latch are inserted into the jack of the buckle, however there is still a gap between the jack of the buckle and the latch, so when sand or dust invades the car, it is easy to further enter through the gap formed between the jack of the buckle and the latch. Once the silt or sand falls into the buckle, because the buckle does not have the function of discharging silt or sand, the silt or sand accumulates in the buckle, which affects the locking mechanism of the buckle. With the enough accumulation of the foreigner objects, the components of the locking structure cannot operate normally, so it affects the securing function of the buckle and the latch, and loses the function of protecting the driver and passengers.

Therefore, it is desirable to provide a multi-point buckle to mitigate and/or obviate the aforementioned problems.

SUMMARY OF THE INVENTION

An objective of present invention is to provide a multi-point buckle which is capable of improving the above-mention problems.

In order to achieve the above mentioned objective, a multi-point buckle has a buckle, at least two latches and a plurality of dust jackets. The dust jacket 3 is employed between the latch and the tongue slot of the buckle to achieve a close fit and seal effects, which not only increases the structural engagement stability between the tongue slot and the tongue but also prevent sand, dust and dirt from falling into the tongue slot not causing the latch from shaking loose and the friction and interference of foreign objects in the buckle Other objects, advantages, and novel features of invention will become more apparent from the following detailed description when taken in conjunction with the accompanying drawings.

DETAILED DESCRIPTION OF THE PREFERRED EMBODIMENT

Figure 7:
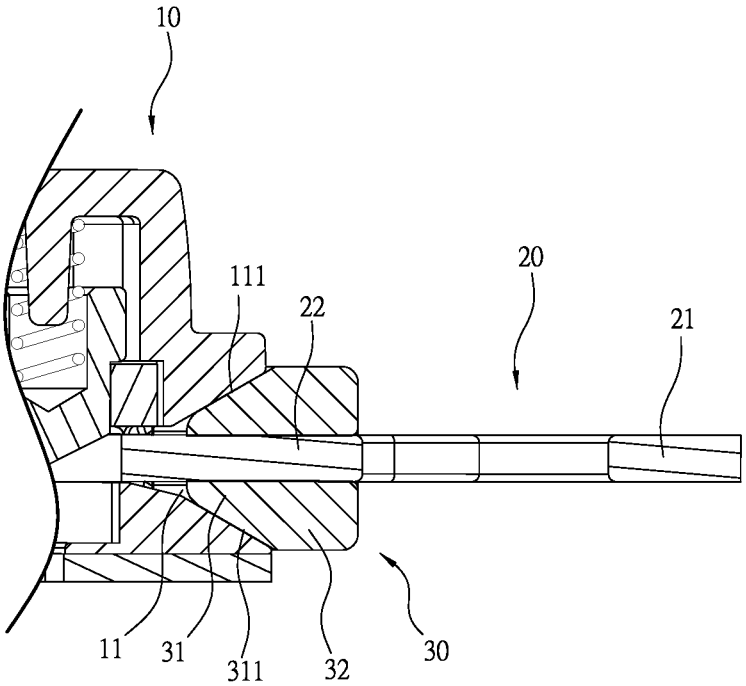
FIG. 7 is a cross-sectional view of the preferred embodiment of the present invention corresponding to the A-A section line shown in FIG. 6.

First, please refer to FIG. 1 to FIG. 4. A multi-point buckle comprises a buckle 10, at least two latches 20 and a plurality of dust jackets 30. The buckle has a plurality of tongue slots 11 on a peripheral edge, and each tongue slot 11 has a converging space 111 (as shown in FIG. 7). Each latch 20 has a handle portion 21 and at least one tongue 22, the handle portion 21 has at least one strap hole 211, and the tongue 22 is insertable into at least one of the tongue slots 11 of the buckle 10 after passing through the dust jacket 30. Furthermore, a front end the tongue 22 of each latch 20 has a positioning end 221 for restricting the dust jacket 30. Each dust jacket 30 is a single piece comprises an engaging portion 31 and a joint portion 32. Each engaging portion 31 is capable of engaging with at least one of the tongue slots 11 of the buckle 10, two side faces of the engaging portion 31 respectively comprises two guiding slopes 311 conformal to the converging space 111, two ends of the engaging portion 31 of each dust jacket 30 respectively have a beveled edge 312 extending with a matching edge 313, and the matching edge 313 has a rounded end 314. Two opposing ends of the joint portion 32 pass two ends of the engaging portion respectively and each has one topping portions 321, and the two stopping portions 321 both abut an outer edge of the buckle 10 to position the joint portion 32 in the tongue slot 11. Each dust jacket 30 further comprises a through slot 33 passing through the joint portion 32 and the engaging portion 31, and the through slot 33 is configured for accepting at least one of the tongues 22 to be locked with the buckle 30. The positioning end 222 of the tongue 22 is wider than the through slot 33, such that when the dust jacket 30 is sleeved onto the tongue 22 it is limited between the positioning end 221 and the handle portion 21.

Moreover, a curved edge 34 is provided between the engaging portion 31 and the joint portion 32 of each dust jacket 30, and the two stopping portions 321 respectively also extend along the curved edge 34 to have a curved shape. Therefore, the buckle 10 has an outer edge with a curved shape, so that the joint portion 32 of the dust jacket 30 can fit more tightly to the outside of the buckle 10.

Figure 1:
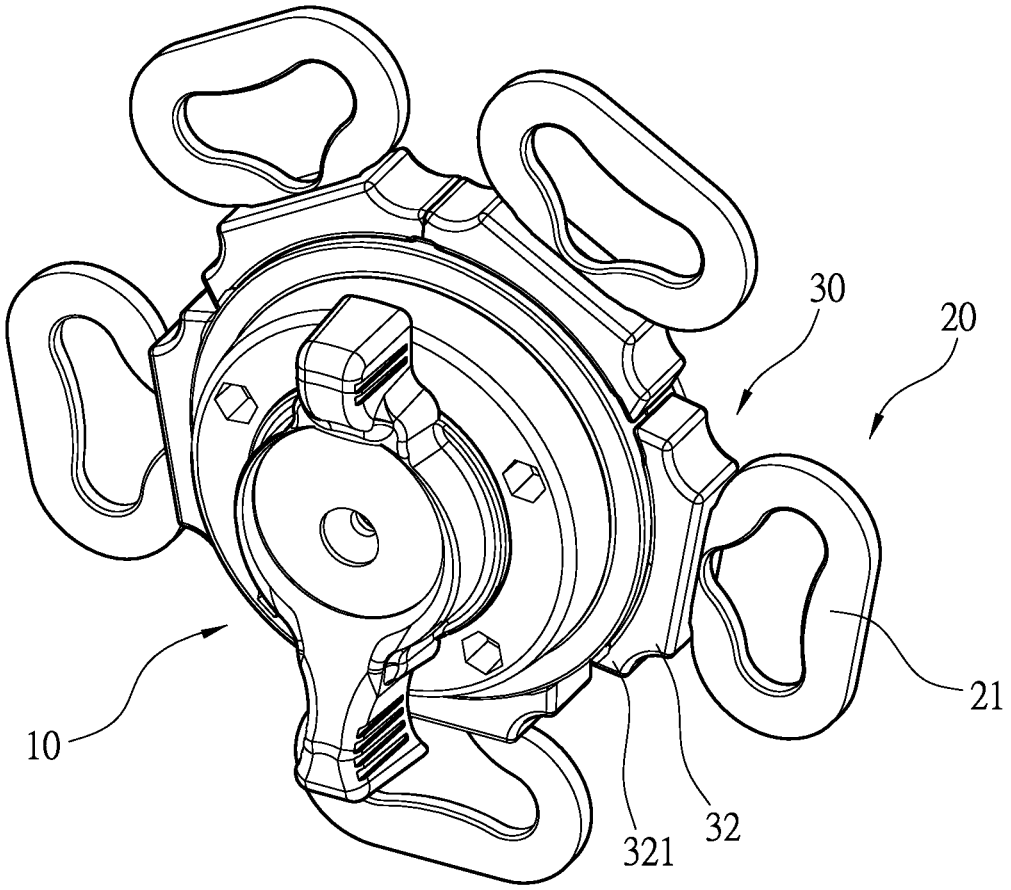
FIG. 1 is a three-dimensional view of the buckle and the latch being fastened together of a preferred embodiment of the present invention.
Figure 2:
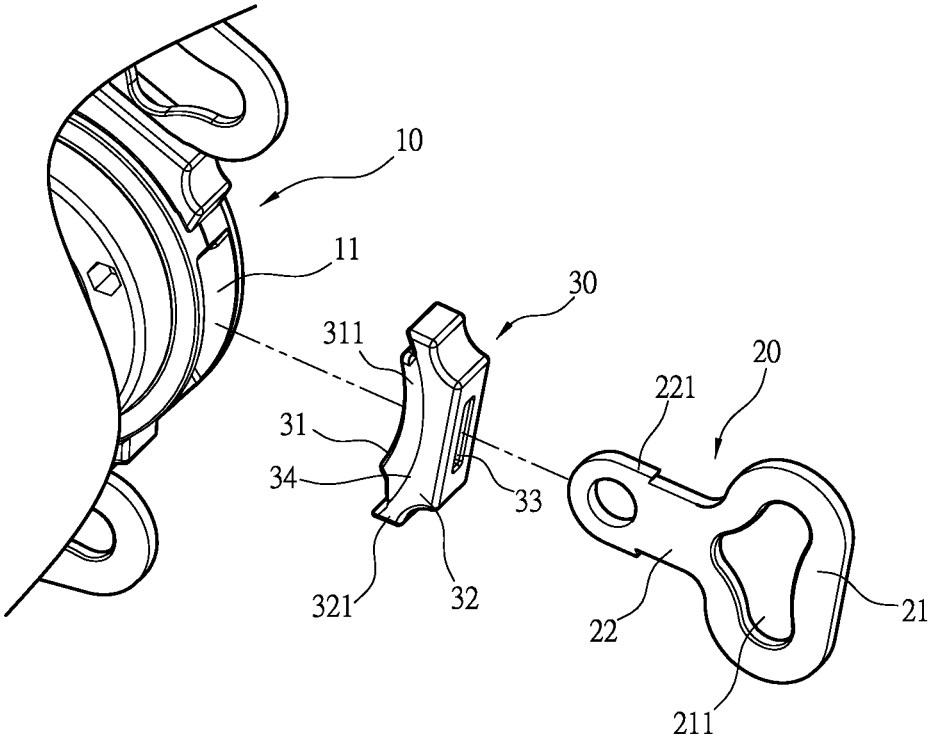
FIG. 2 is an exploded view of the preferred embodiment of the present invention.
Figure 3:
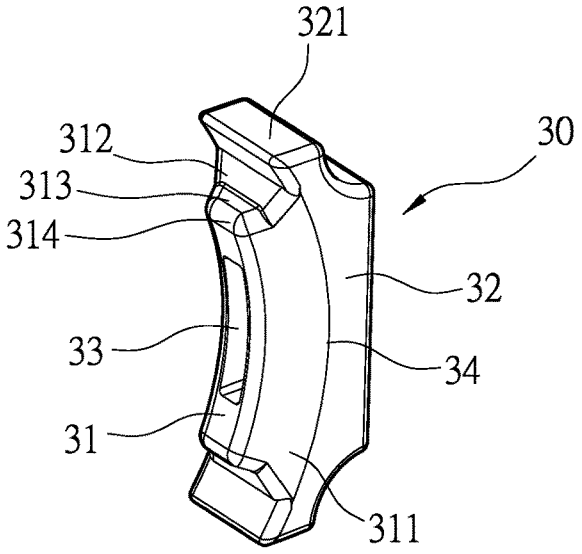
FIG. 3 is a three-dimensional view of the dust jacket of the preferred embodiment of the present invention.
Figure 4:
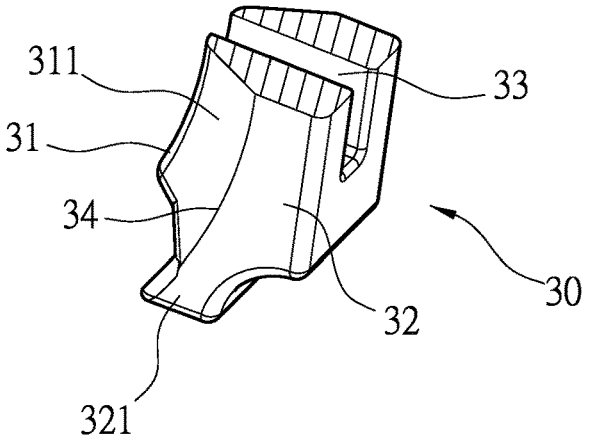
FIG. 4 is a three-dimensional cross-sectional view of the dust jacket of the preferred embodiment of the present invention.
Figure 5:
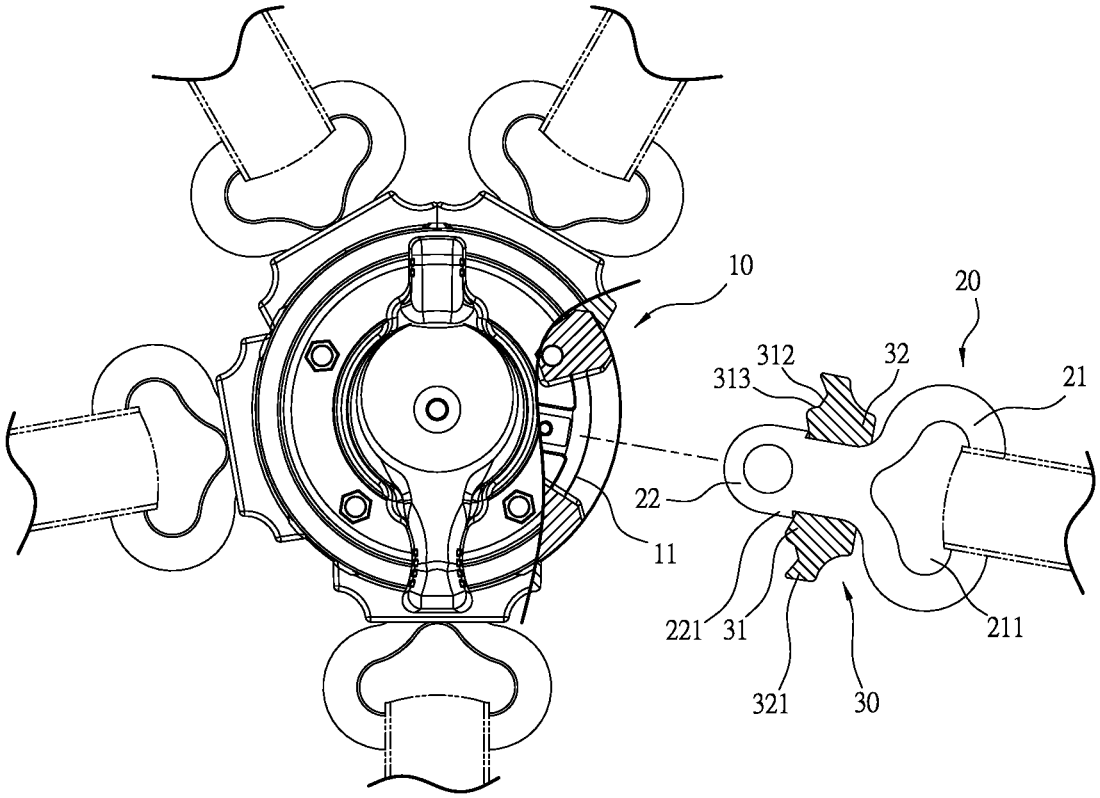
FIG. 5 is a schematic diagram of the actual use of the buckle of the preferred embodiment of the present invention.
Figure 6:
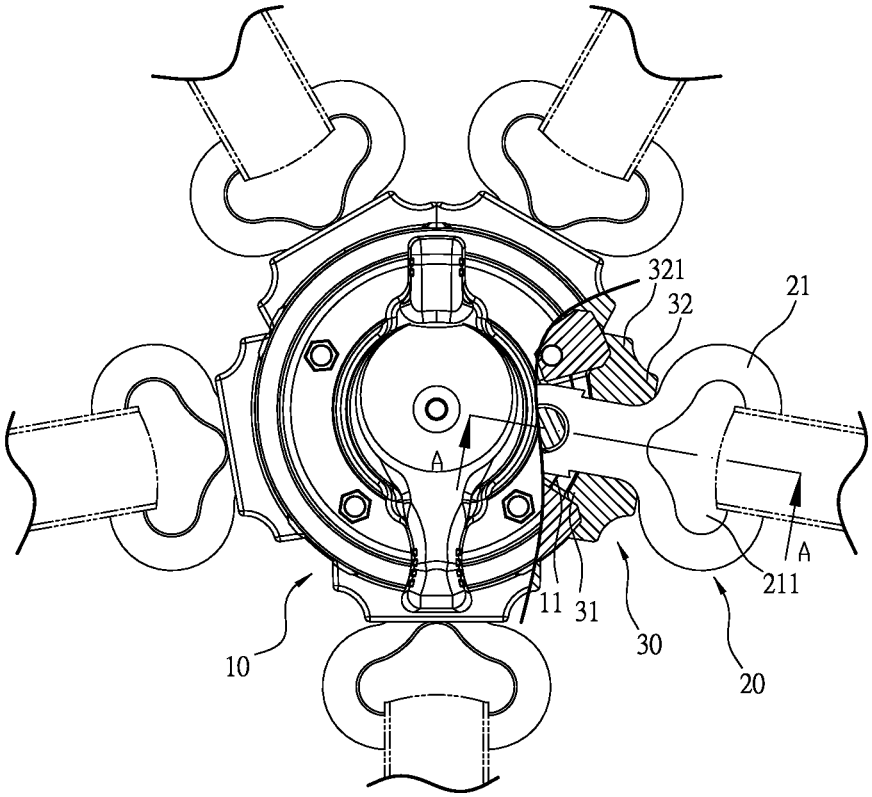
FIG. 6 is a schematic diagram of the actual buckle fixation of the preferred embodiment of the present invention.

The use of its structure, as shown in FIGS. 5, 6, and 7. The tongue 22 of the latch 20 is inserted in one dust jacket 30, and the tongue 22 enters from the joint portion 32 to pass through the through slot 33 and exit out the engaging portion 31. The joint portion 32 of the dust jacket 30 faces the handle portion 21, and with the flexible and resilient plastic properties of the dust jacket 30, the dust jacket 30 is indeed enveloped around the tongue 22 and is limited by the positioning end 221 at the front end of the tongue 22. Furthermore, the dust jacket 30 is further positioned between the positioning end 221 and the handle portion 21, and then the tongue 22 of the latch 20 is inserted into the tongue slot 11 of the buckle 10 to secured the seat belt buckle, the engaging portion 31 of the dust jacket 30 is guided and inserted into the tongue slot 11 with the bevel edge 312 and the matching edge 313 at its both ends, and use the guiding slope 311 on its both sides to be gradually close to the converging space 111 of the tongue slot 11, so that the gap formed between the tongue slot 11 and the tongue 22 can be effectively filled with the engaging portion 31 which improves the tightness of the latch 20. Also, with the stopping portion 321 abuts both sides of the tongue slot 11, and the joint portion 32 tightly engages with the outer edge of the buckle 10 to seal the tongue slot 11, which prevents sand and dust from entering into the tongue slot 11, thereby improving the buckle stability between the latch 20 and the buckle 10.

Figure 8:
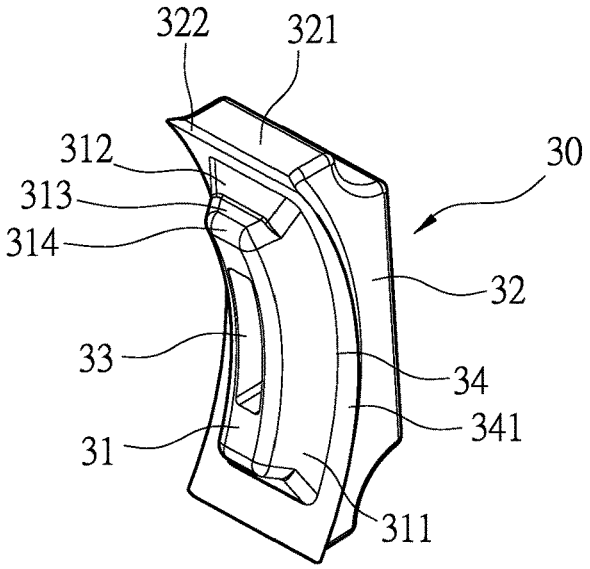
FIG. 8 is another embodiment of the preferred embodiment of the present invention.
Figure 9:
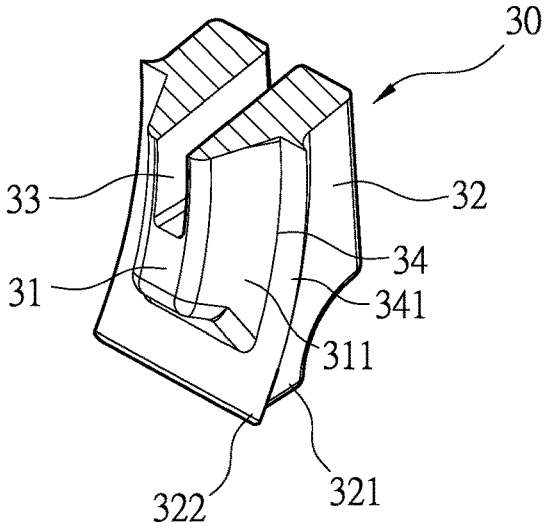
FIG. 9 is a partial cross-sectional view of another embodiment of the present invention.
Figure 10:
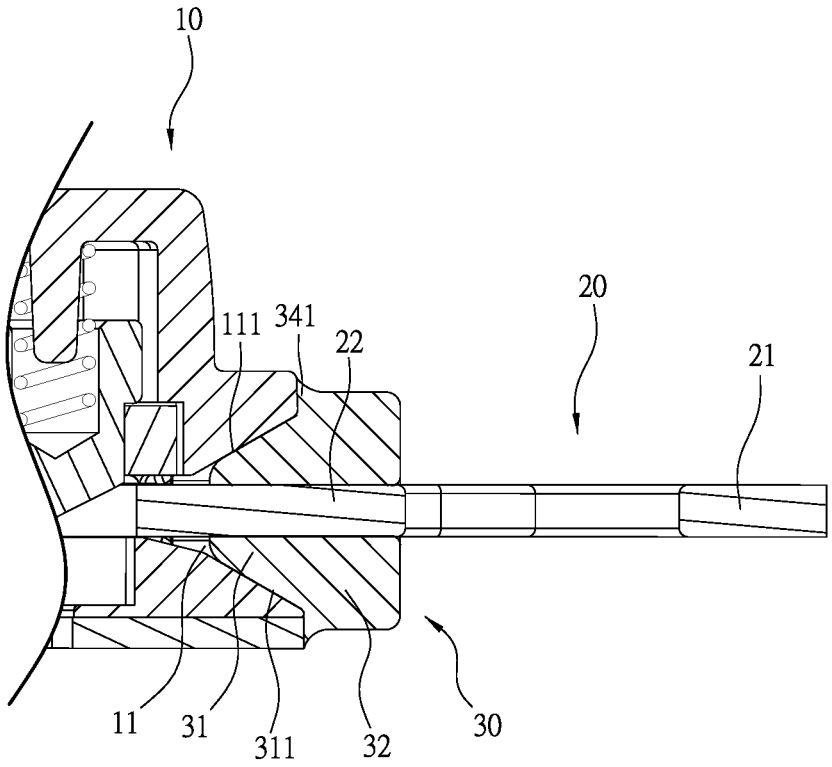
FIG. 10 is an assembled cross-sectional view of another embodiment of the present invention.

In another embodiment of the present invention, as shown FIGS. 8-10, two opposed edges of each the joint portion 32 other than the stopping portions 321 further respectively have two closing lips 341 along the curved edge 34, and an end edge of each of the two stopping portions 321 further has a jointing lip 322 connected to the closing lip 341 as a single piece. Therefore, with the closing lip 341 and the jointing lip 322 more closely attached to the outer edge of the buckle 10 to ensure that no sand and dust entering into the tongue slot 11.

With the structure of the above specific embodiment, the following benefits can be obtained: the dust jacket 30 is employed between the latch 20 and the tongue slot 11 of the buckle 10 to achieve a close fit and seal effects, which not only increases the structural engagement stability between the tongue slot 11 and the tongue 22 but also prevent sand, dust and dirt from falling into the tongue slot 11 not causing the latch 20 from shaking loose and the friction and interference of foreign objects in the buckle 10, for improved safety and value of seat belt buckles.

Although the present invention has been explained in relation to its preferred embodiment, it is to be understood that many other possible modifications and variations can be made without departing from the spirit and scope of invention as hereinafter claimed.

What is claimed is:

1. A multi-point buckle comprising: a buckle, at least two latches, and a plurality of dust jackets; the buckle having a plurality of tongue slots on a peripheral edge, each latch having a handle portion and at least one tongue, the handle portion having at least one strap hole, the tongue being insertable into at least one of the tongue slots of the buckle; characterized in that:

each tongue slot has a converging space, each dust jacket is a single piece comprising an engaging portion and a joint portion; each engaging portion is capable of engaging with at least one of the tongue slots of the buckle, two side faces of the engaging portion respectively comprising two guiding slopes conformal to the converging space, two opposing ends of the joint portion passing two ends of the engaging portion respectively having two stopping portions, the two stopping portions abutting an outer edge of the buckle to position the joint portion in the tongue slot; and each dust jacket further comprises a through slot passing through the joint portion and the engaging portion, and the through slot is configured for accepting at least one of the tongues to be locked with the buckle.

2. The multi-point buckle as claimed in claim 1, wherein a front end the tongue of each latch has a positioning end, the positioning end being wider than the through slot, such that when the dust jacket is sleeved onto the tongue it is limited between the positioning end and the handle portion.

3. The multi-point buckle as claimed in claim 1, wherein two ends of the engaging portion of each dust jacket respectively have a beveled edge extending with a matching edge, and the matching edge has a rounded end.

4. The multi-point buckle as claimed in claim 1, wherein a curved edge is provided between the engaging portion and the joint portion of each dust jacket, and the two stopping portions respectively also extend along the curved edge to have a curved shape.

5. The multi-point buckle as claimed in claim 4, wherein two opposed edges of each joint portion other than the stopping portions further respectively have two closing lips along the curved edge, and an end edge of each of the two stopping portions further has a jointing lip connected to the closing lip as a single piece.

* * * * *